US007461730B2

(12) United States Patent
Costa et al.

(10) Patent No.: US 7,461,730 B2
(45) Date of Patent: Dec. 9, 2008

(54) HANDLE APPARATUS WITH CANTILEVERED HANDLE GRIP FOR LUGGAGE CASE

(75) Inventors: Richard A. Costa, San Francisco, CA (US); Glenn H. Rodgers, Jr., San Francisco, CA (US); Noah M. Han, San Francisco, CA (US); Sung O. Yang, San Francisco, CA (US)

(73) Assignee: Inventive Travelware, San Francisco, CA (US)

( * ) Notice: Subject to any disclaimer, the term of this patent is extended or adjusted under 35 U.S.C. 154(b) by 91 days.

(21) Appl. No.: 10/488,851

(22) PCT Filed: Sep. 5, 2002

(86) PCT No.: PCT/US02/28054

§ 371 (c)(1),
(2), (4) Date: Mar. 8, 2005

(87) PCT Pub. No.: WO03/020069

PCT Pub. Date: Mar. 13, 2003

(65) Prior Publication Data

US 2005/0150732 A1 Jul. 14, 2005

Related U.S. Application Data

(60) Provisional application No. 60/317,531, filed on Sep. 5, 2001.

(51) Int. Cl.
*A45C 13/26* (2006.01)
*A45C 5/14* (2006.01)

(52) U.S. Cl. ..... 190/39; 190/18 A; 190/115; 16/113.1; 16/114.1; 280/655.1

(58) Field of Classification Search ..... 190/39, 190/115, 18, 116, 18 A; 16/113.1, 409, 114.1, 16/408, 438; 280/655.1
See application file for complete search history.

(56) References Cited

U.S. PATENT DOCUMENTS 959,235 A * 5/1910 Lemieux ..... 16/429

(Continued)

FOREIGN PATENT DOCUMENTS

GB 2111465 A * 7/1983

(Continued)

*Primary Examiner*—Sue A Weaver
(74) *Attorney, Agent, or Firm*—Foley & Lardner LLP

(57) ABSTRACT

A wheeled luggage case (1) has a single telescoping handle arm assembly (10) and a cantilevered handle grip (11) which is rotatably attached to the top end (13) of the handle arm assembly, such that the plane of rotation of the grip is approximately parallel to the rolling direction of the luggage case. The cantilevered handle grip (11) rotates from a position approximately perpendicular to the telescoping handle arm assembly (10) to a position approximately 30° below the horizontal, and a resilient element is provided which urges the grip to rotate downwardly while in use. The invention provides an ergonomically comfortable wheeled luggage case by allowing the user to grasp the grip in a natural position and, simultaneously, increasing the amount of leverage available to prevent the luggage case from tipping over when it is rolled over uneven ground. Further, the resilient element distributes the weight of the luggage case evenly across the user's hand.

20 Claims, 6 Drawing Sheets

U.S. PATENT DOCUMENTS 1,933,637 A * 11/1933 Plym ..... 16/439
4,118,048 A * 10/1978 Spranger et al. ..... 280/47.35
4,261,077 A 4/1981 Brock et al.
4,299,313 A * 11/1981 Null ..... 190/18 A
4,358,006 A * 11/1982 Castelli ..... 190/18 A
4,538,709 A 9/1985 Williams et al.
4,561,526 A 12/1985 Winter et al.
5,075,925 A 12/1991 Maloney
5,343,988 A 9/1994 Bartsch et al.
5,353,900 A 10/1994 Stilley
5,370,409 A * 12/1994 Latouche ..... 280/47.26
5,579,877 A 12/1996 Homayoon
5,722,118 A 3/1998 Hansen et al.
5,901,822 A 5/1999 Tu
5,934,425 A * 8/1999 Sadow ..... 190/115
5,943,936 A 8/1999 Deliman et al.
6,202,254 B1 3/2001 Ezer
6,301,746 B1 * 10/2001 Myers et al. ..... 16/113.1
6,357,567 B1 * 3/2002 Tsai ..... 190/18 A
2002/0050429 A1 * 5/2002 Nykoluk et al. ..... 190/115
2002/0116790 A1 * 8/2002 Walker ..... 16/422
2003/0000785 A1 * 1/2003 Miller et al. ..... 190/115
2003/0102195 A1 * 6/2003 Mittleman et al. ..... 190/115
2004/0132080 A1 * 7/2004 Kawaguchi et al. ..... 435/6

FOREIGN PATENT DOCUMENTS

GB 1600156 * 10/1991

* cited by examiner

HANDLE APPARATUS WITH CANTILEVERED HANDLE GRIP FOR LUGGAGE CASE

FIELD OF INVENTION

The present invention relates generally to the field of rollable luggage cases and to other types of cases.

BACKGROUND OF INVENTION

Most current wheeled luggage systems use a similar design consisting of two telescoping tubes or arms attached to the back side of the luggage compartment and a handle grip connected across the top of the tubes to form an upside-down "U" shaped steering handle. Two wheels are usually provided on opposite sides of the bottom back side of the luggage compartment. In operation a user extends the telescoping tubes out of the luggage compartment by pulling upward on the handle grip, tilts the luggage to a comfortable and stable position, and rolls the luggage along its wheels. When the user stops moving, the luggage may be tilted upright on its bottom end, by normally resting the luggage on a "bottom stud" adjacent to the wheels. This type of rollable luggage has become known as "Uprights," "Trolley Cases," or "Vertical Pullmans." Prior to this design, luggage was generally wheeled by placing it on a separate rolling luggage cart. The carts were normally made of tubular metal, having wheels and a "U" shaped telescoping steering handle which could be collapsed into an outer tube, when not in use. The uprights in popular use today were developed by essentially integrating the luggage cart into the luggage compartment.

Although the "U" shaped or double-tube design used in current luggage cases is primarily a legacy of the collapsible luggage carts, the redundant design does not appear to be a functional necessity. Recently, single tube designs have been introduced. For example, in U.S. Pat. No. 5,943,936, and U.S. Pat. No. 6,202,254 B1, both patents show a single steering handle design which retracts into and extends out of an outer tube or portion of the luggage compartment. Each of these designs discloses a handle grip, which is either integral to the handle arm, as in the 6,202,254 B1 patent, or is rigidly attached to the handle arm, as in the 6,202,254 B1 patent. Each design also orients the handle grip such that its horizontal grip portion is perpendicular to the direction the luggage is rolled. These grip designs present several problems for the user.

One problem is that in order for a user to grasp the grip handle, the user must rotate or twist his or her arm approximately 90° from the arm's natural position, hanging at the user's side. This twisting motion puts a certain amount of strain on the user's wrist, elbow, and shoulder joint, and can cause discomfort when pulling heavy loads or loads over a long distance.

Another problem is that all rolling luggage systems have a tendency to tip over when the luggage is rolled over uneven ground. Unfortunately, current handle grip designs which place the user's hand and arm in an unnatural twisted position, actually exacerbate the tipping problem because a person's arm has less strength in an unnatural position. Thus, the luggage is more likely to tip over.

Tipping also causes another problem. If the user cannot efficiently counteract the tipping motion while the luggage is being rolled, the luggage may be dragged, rather than rolled, causing excessive wear to an outside portion of the wheel. This unwanted action causes the wheel to develop a flat spot, which will eventually require that it be replaced. It is generally known that wheel replacement or repair is a common maintenance expense in the use of wheeled luggage.

One recent design that attempts to orient the grip in the direction of travel is disclosed in U.S. Pat. No. 5,722,118. This patent, however, discloses a method for converting a "U" shaped handle system to a single grip system, by providing a handle apparatus that is a separate attachment. Unfortunately, since the handle is not integral with the preexisting "U" shaped handle, the design introduces a substantial instability problem which contributes to the wheel damage described above. The add-on handle is also not easy to use, and prone to being lost or damaged.

The present invention overcomes these disadvantages in current wheeled luggage by allowing the user to grasp the luggage handle grip in a natural and ergonomically comfortable position, and at the same time, increases the amount of leverage available to the user when the luggage is rolling over uneven ground or is otherwise tipped. These and other advantages are more fully described in connection with the following summary and detailed description of the invention.

SUMMARY OF THE INVENTION

The present invention provides for a wheeled luggage case which includes a luggage frame, two wheels in axial alignment attached to a longitudinal bottom edge portion of the frame, and a handle system having a single telescoping handle arm assembly, including an integral cantilevered handle grip. A luggage case compartment generally surrounds and is attached to the luggage frame. The telescoping handle arm assembly has an outer tubular member, and a first inner tubular member which is slideably positioned within the outer member. A second inner tubular member is similarly slideably disposed within the first inner tubular member. In a retracted position, the first and second inner tubular members are substantially disposed within the outer tubular member, and in a fully extended position the first inner tubular member is extended substantially outside of the outer tubular member and the second inner tubular member is extended substantially outside of the first inner tubular member.

The present invention's cantilevered handle grip system has a front grip end and a back grip end, with its back grip end rotatably attached to the top end of the second tubular member by means of a hinge, which enables the handle grip to rotate in a single vertical plane, which is coextensive with the handle arm assembly and approximately parallel to the wheeled direction of the wheeled luggage case.

The handle system, including the telescoping handle arm assembly and cantilevered handle grip, is attached to the luggage frame such that the handle grip is perpendicular to the axis of each of the two wheels, and is generally parallel to the vertical plane of rotation of each wheel. When the handle arm assembly is extended, the front grip end of the handle grip extends over the upright end of the luggage case. And, when the handle arm assembly is retracted, the handle grip's front grip end is releaseably locked into a portion of the frame. In its locked position, the handle grip can be used as a luggage case handle to carry or lift the luggage.

Orienting the cantilevered grip handle in the direction of travel enables the user to grasp the handle in a more ergonomically compatible manner, without any excessive twisting of the wrist, elbow and shoulder joints. This more natural position allows the user's arm to swing freely and comfortably while pulling the luggage case. From this position, the arm is also stronger since it is not using any unnecessary energy to hold the wrist, elbow and shoulder joints in twisted positions. Since the arm is in a stronger and more natural position, it can more easily prevent the luggage case from tipping over.

The hinge, which attaches the cantilevered handle grip's back grip end to the top of the second inner tubular member, is constructed such that it only permits the handle grip to rotate in an arc of approximately 30° below the horizontal. This range of motion is ergonomically designed to allow the user's hand and wrist to remain comfortably aligned with the forearm, while pulling the luggage with the arm swinging back-and-forth at his or her side.

Another ergonomic feature of the invention is that the cantilevered handle grip is attached to the handle arm such that a slight resilient force is applied to the hinge, causing the grip to rotate or hinge in a downward direction, while the luggage case is being pulled. This force acts to distribute the weight of the luggage uniformly across the fingers and palm of the user's hand. In this manner, a concentration of the luggage case's weight at the front of the hand is minimized.

DETAILED DESCRIPTION OF THE INVENTION

Figure 1:
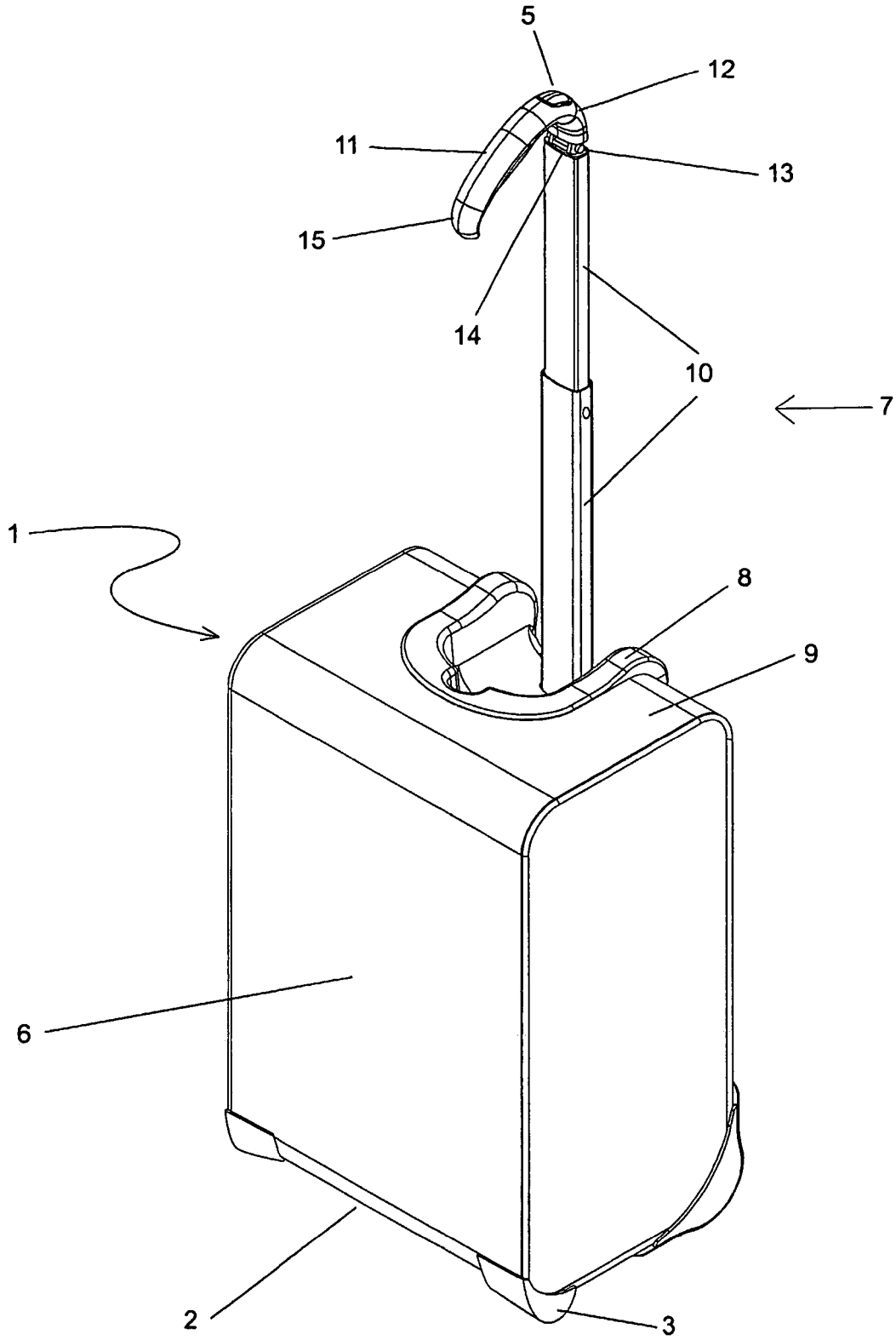
FIG. 1 is a front perspective view of a wheeled luggage case with a handle assembly, including a telescoping handle arm assembly and a cantilevered handle grip, in an extended position.

The present invention is generally described in connection with FIGS. 1, 2 and 3. FIG. 1 illustrates a perspective view of a wheeled luggage case 1 which is tipped up on a bottom end 2 and is resting in a vertical position on a pair of bottom studs 3 and on a pair of wheels 4, which are adjacent to the bottom studs 3. The axle of each wheel 4, is in axial alignment with the other wheel, and each wheel and its corresponding axle is rotatably mounted to a luggage frame 16. A luggage compartment 6 is disposed around and attached to the luggage frame 16. A handle assembly 7 extends through a handle grip cradle 8 disposed within an upright end 9 of the luggage case 1. The handle assembly 7 includes a single telescoping handle arm assembly 10, which is depicted in its extended position. The handle assembly also contains an integral cantilevered handle grip 11 which is connected at a back grip end 12 to a top end 13 of the telescoping handle arm assembly 10 by means of a hinge assembly 14. The hinge 14 limits the rotation of the handle grip 11 to a vertical plane which is coextensive with the handle arm assembly 10 and generally parallel to the vertical plane of rotation of each wheel. A front grip end 15 extends away from the handle arm assembly 10 and across the upright end 9 of the luggage case 1.

Figure 2:
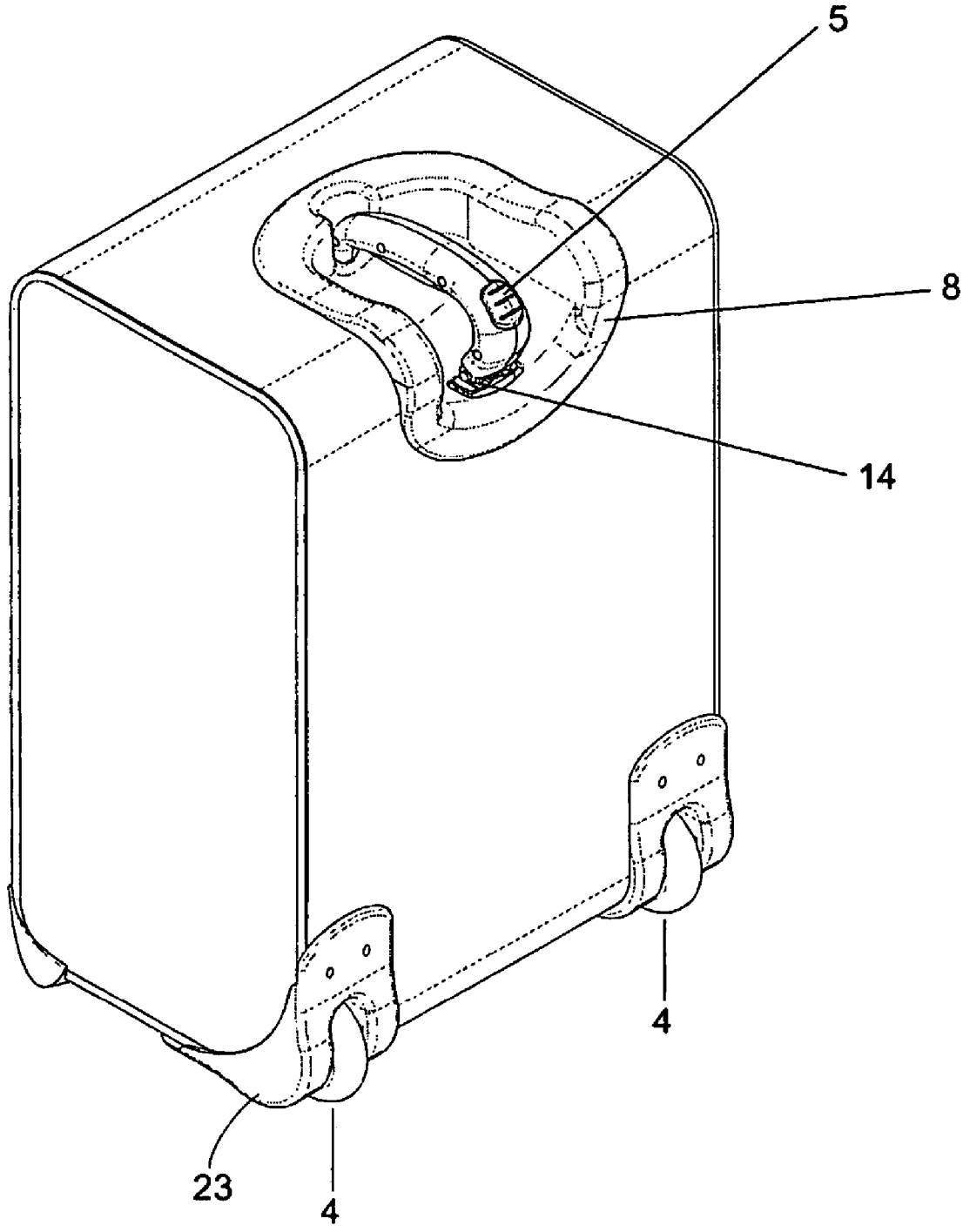
FIG. 2 is a back perspective view of the wheeled luggage case with the handle assembly in a retracted position and the cantilevered handle grip locked into a portion of the luggage frame.

FIG. 2 presents a perspective view of the luggage case 1 illustrating the handle assembly 7 in a retracted position, the cantilevered handle grip 11 disposed within the grip cradle 8, and the handle grip's front grip end 15 is releasably locked into the cradle 8. In this position, the handle grip 11 can be used as a normal luggage handle to carry the luggage case 1. The top portion of the handle grip 11 is flush with the upright end 9 of the luggage case 1 which prevents the handle grip 11 from being damaged. A release button 5 is also conveniently disposed on the top portion of the cantilevered handle grip 11 adjacent to the back grip end 12. This location permits the user to easily release the handle grip 11 from its locked position within the handle grip cradle 8 by grasping the handle grip 11 and using the thumb to press the release button 5 down. The user then pulls up on the handle grip 11 in order to extend the telescoping handle arm assembly 10.

Figure 3:
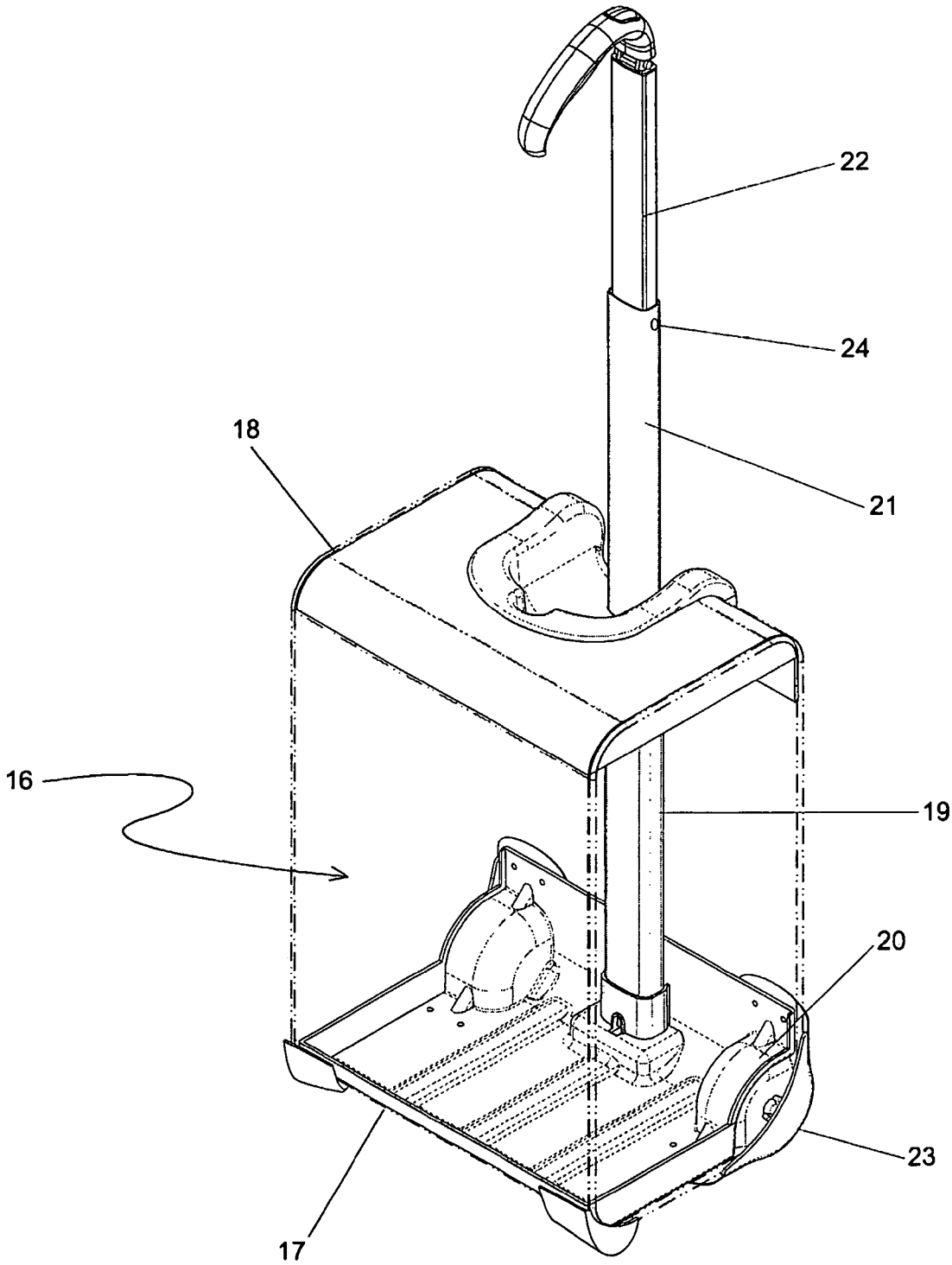
FIG. 3 is the same front perspective view of the wheeled luggage case as shown in FIG. 1 with the luggage case compartment shown in dashed lines in order to reveal the inner luggage frame.

FIG. 3 presents a "see through" perspective illustration of the luggage case 1 as shown in FIG. 1 with the luggage compartment 6 shown in dashed lines so as to reveal the luggage frame 16, and a more complete view of the telescoping handle arm assembly 10 in its extended position. The luggage frame 16 consists of a bottom tray 17 and a top tray 18, which respectively provide structural support to the bottom end 2 and upright end 9 of the luggage case 1. The two trays are rigidly connected to each other by means of an outer tubular member 19, which extends vertically between a back center portion of the bottom tray 17 and a back center portion of the top tray 18. A pair of wheel retainers 20 are integral with the bottom tray 17 and are located at opposite back corners of the tray 17. A pair of wheel housings 23 are adjacent to the pair of wheel retainers 20, and each housing 23 holds a wheel axle, and it associated wheel, in axial alignment with the other wheel axle, and its associated wheel. Although not shown in the figure, each wheel housing 23 contains a pair of removable clips which permit a user to easily remove and replace a wheel assembly.

As can be further seen in the figure, the outer tubular member 19, which is part of the luggage frame 16, is also part of the telescoping handle arm assembly 10. A first inner tubular member 21 is slideably positioned within the outer tubular member 19 and a second inner tubular member 22 is similarly slideably positioned within the first inner tubular member 21. The first and second tubular members 21 and 22 are both shown in a fully extended position. Although not shown in the figure, the outer tube member 19, inner tuber member 21 and inner tube member 22 each contain internal locking mechanisms that lock the tubes in place when fully extended or fully retracted. These mechanisms also permit the tubes to be easily released from a locked position by simply pulling up or pushing down on the handle grip 11. The user releases the tubes by pressing down on the release button 5 which activates a lever mechanism within the second inner tuber member 21 which in turn retracts a first pin 24 disposed within a hole through the side of the first inner tuber member 21. Once the first pin 24 is retracted, the user simply pushes down on the cantilevered handle grip 11 to retract the telescoping handle arm assembly 10. In its fully retracted position, a second pin (not shown), engages the outer tubular member 19 in order to hold the telescoping handle arm assembly 10 in a locked position. In this position, the handle grip 11 is secured within the handle grip cradle 8, by means of a small indent disposed within the grip front end 15 which mates with a retractable flange member disposed within the cradle 8. In order to release the handle grip 11 and telescoping handle arm assembly 10, the user pushes down on the release button 5, which retracts the second pin and the handle grip 11 rotates away from the retractable flange member.

Further, the present invention has been disclosed as having one fixed outer tubular member and two telescoping inner tubular members, it will be readily apparent to those skilled in the art that depending upon the size of the luggage case, the invention includes a single, fixed tubular member without any corresponding telescoping members; and includes a fixed outer tubular member with only one telescoping member or more than two such members.

Figure 4:
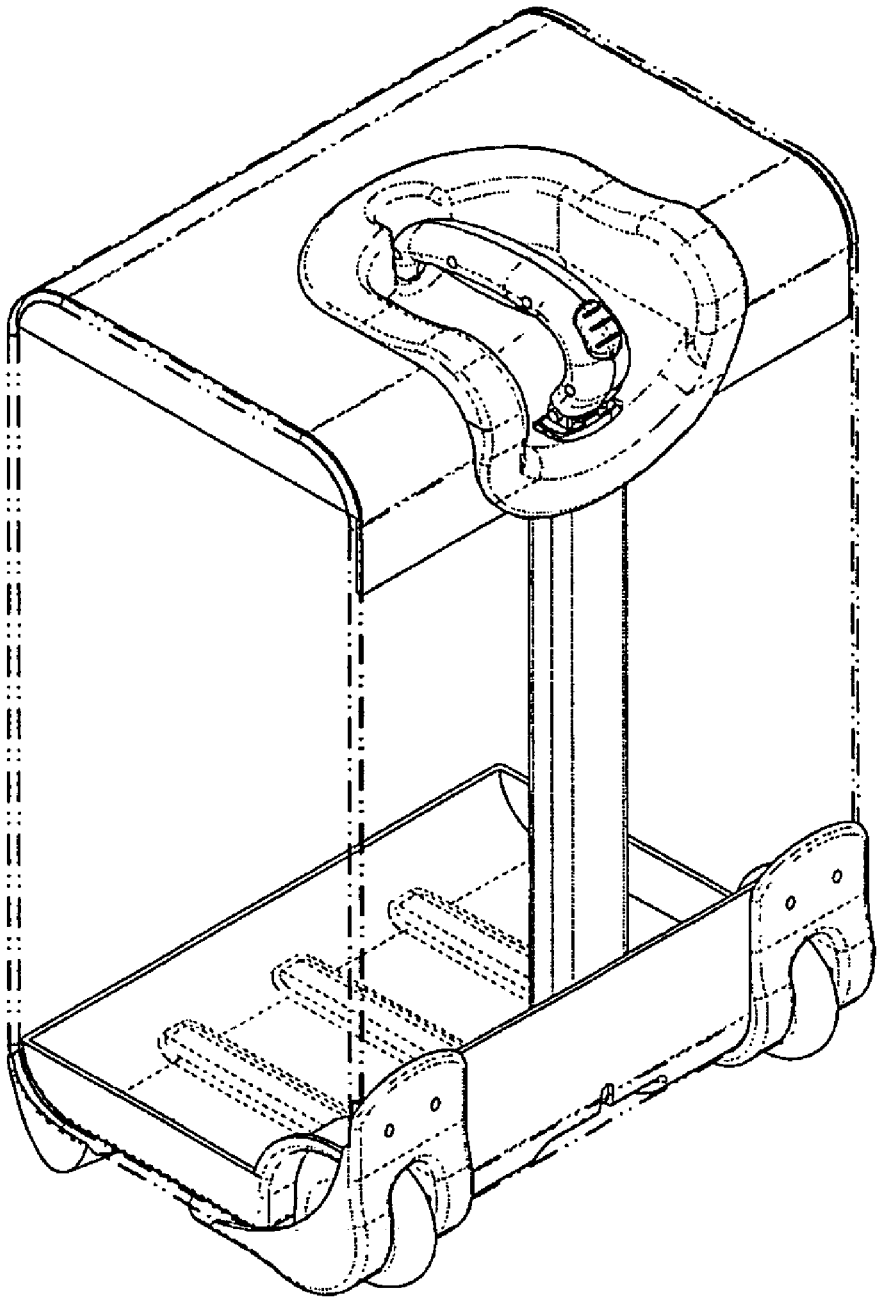
FIG. 4 is the same back perspective view of the wheeled luggage case as shown in FIG. 2 with the luggage case compartment shown in dashed lines in order to reveal the luggage frame.

FIG. 4 presents a "see through" perspective drawing of the luggage case 1 as shown in FIG. 2 with the luggage compartment 6 shown in dashed lines in order to reveal the luggage frame 16 as viewed from the back of the case 1.

Figure 5:
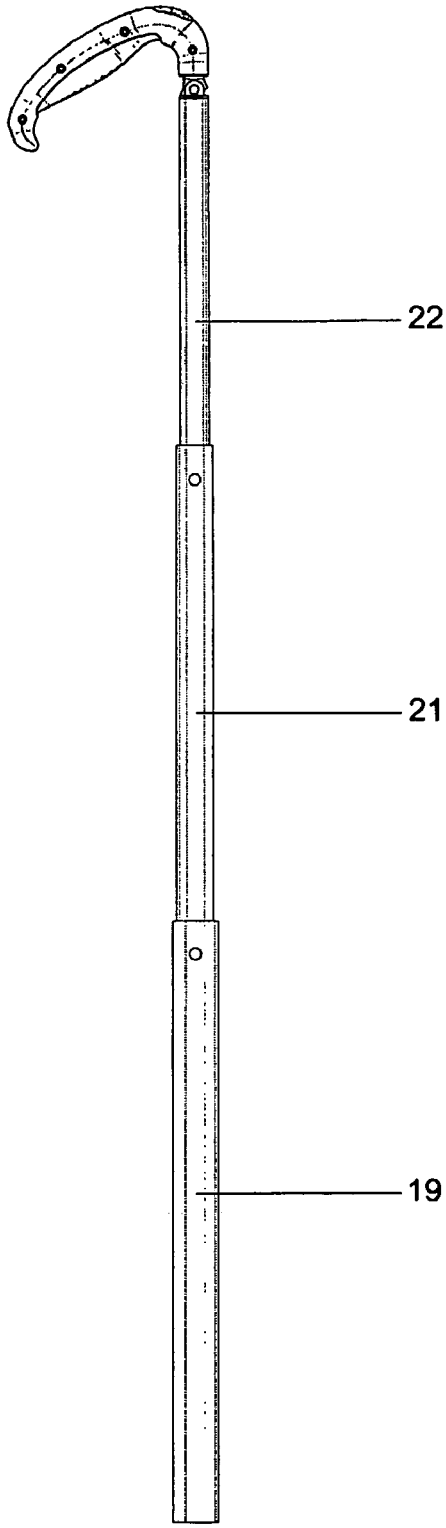
FIG. 5 is a side view of the handle assembly with the telescoping handle arm assembly extended.

A profile view of the telescoping handle arm assembly 10 and cantilevered handle grip 11, removed from the luggage case 1, is illustrated in FIG. 5. This figure shows in more detail the exact telescoping relationship of the outer tubular member 19, first inner tubular member 21 and second inner tubular member 22, each in its extended position.

Figure 6B:
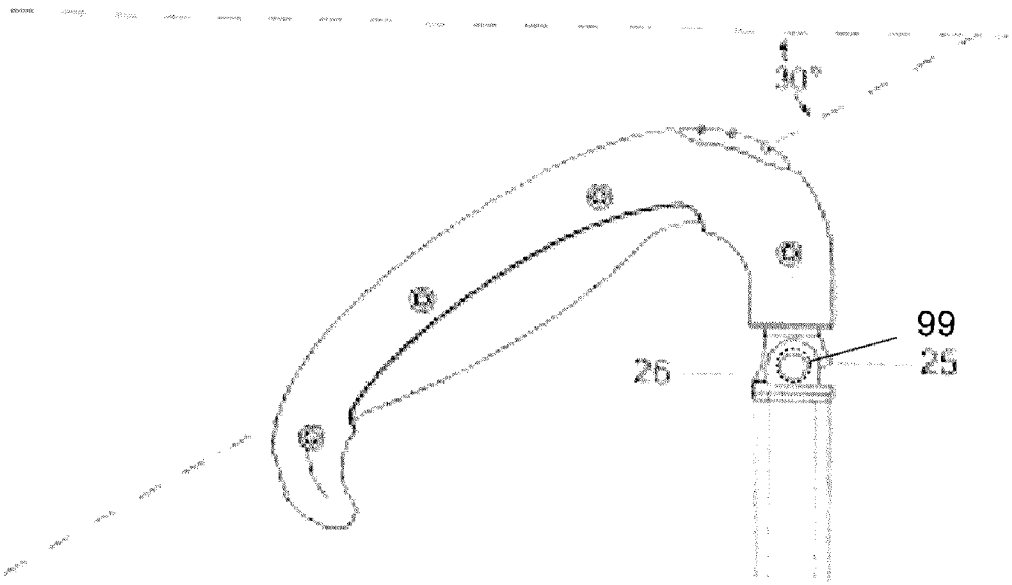
FIG. 6*b* is a side view of the cantilevered handle grip in its relaxed or down position.
Figure 6A:
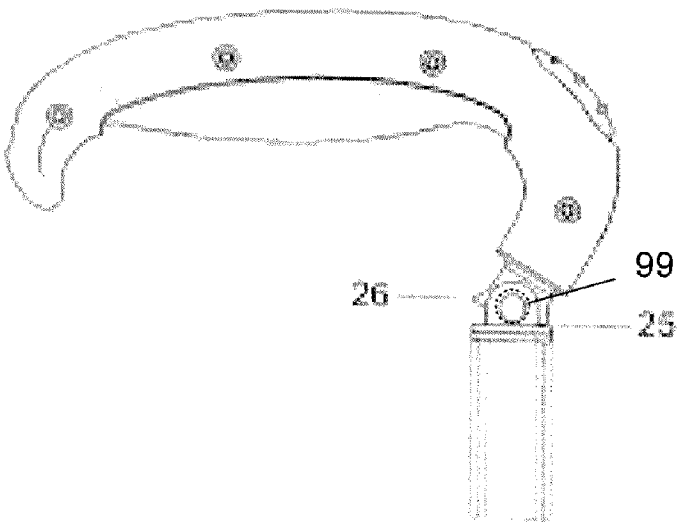
FIG. 6*a* is a side view of the cantilevered handle grip in its rotated or up position.

FIGS. 6*a* and 6*b* illustrate the functional aspect of the cantilevered handle grip 11 which more uniformly distributes the weight of the luggage case 1 across the user's hand when the case 1 is being pulled. FIG. 6*a* depicts the handle grip in its fully rotated position which is caused by the user applying an upward force against the handle grip 11, normally while pulling the luggage case 1. FIG. 6*b* shows the handle grip 11 in its relaxed and unbiased position, which is its state when the user is not applying any upward force against the bottom portion of the handle grip 11. A resilient element, such as a spring, is integral with the hinge assembly 14 such that when the user rotates the handle grip 11 upwards, a counter rotational force is created which pushes the handle grip downward and into the user's hand. In this manner, while the luggage case 1 is being pulled, the weight of the luggage case 1 is more evenly distributed across the user's hand, rather than concentrated at only the front part of the hand.

The hinge assembly 14 contains an integral upward stop flange 25 disposed on an outside portion of the hinge assembly 14 and an integral downward stop flange 26, disposed on an inside portion of the hinge assembly 14. As shown in FIG. 6*a*, the upward rotation of the handle grip 11, caused by a user pulling up on the grip 11, is limited to an orientation which is approximately perpendicular to the telescoping handle arm assembly 10 when the upward stop flange 25 abuts against the telescoping handle arm assembly's top end 13. And, as shown in FIG. 6*b*, the downward rotation of the handle grip 11, caused by the spring, is limited to an orientation in which the grip 11 is in a position which is approximately 30° below the grip's perpendicular orientation to the telescoping handle arm assembly 10, when the downward stop flange 26 abuts against the telescoping handle arm assembly's top end 13. Experiments have shown that this range of rotational motion is ergonomically beneficial in that the motion allows the user's hand and wrist to remain comfortably aligned with the forearm, while pulling the luggage with the arm swinging back and forth at the user's side.

While the present invention has been described with reference to a few embodiments, the description is illustrative of the invention and is not to be construed as limiting the invention. Various modifications may occur to those skilled in the art without departing from the scope of the invention as defined by the appended claims.

We claim:

1. A wheeled luggage apparatus, comprising:

a) a wheeled luggage case;

b) a handle assembly attached to the wheeled luggage case;

c) a cantilevered handle grip rotatably attached to the handle assembly such that the plane of rotation of the grip is approximately parallel to the rolling direction of the wheeled luggage case and extending across an upright end of the wheeled luggage case, the cantilevered handle grip further having a hinge assembly which rotatably attaches the grip to the handle assembly, the hinge assembly having an upward stop flange and a downward stop flange which limit the rotation of the cantilevered hand grip around a hinge to approximately 30°.

2. The wheeled luggage apparatus of claim 1, wherein the hinge assembly further having a resilient element which supplies a force to the cantilevered handle grip and to the handle assembly, urging the grip to rotate downwardly around the hinge.

3. The wheeled luggage apparatus of claim 2 in which the resilient element is a spring.

4. The wheeled luggage apparatus of claim 1 in which the upward stop flange is positioned on an outside portion of the hinge such that the upward stop flange limits the upward rotation of the cantilevered handle grip to a position in which the grip is approximately perpendicular to the handle assembly.

5. A wheeled luggage apparatus, comprising:

a) a wheeled luggage case;

b) a telescoping handle arm assembly attached to the wheeled luggage case; and c) a cantilevered handle grip rotatably attached to the telescoping handle arm assembly such that the plane of rotation the grip is approximately parallel to the rolling direction of the wheeled luggage case and extending across an upright end of the wheeled luggage case, the cantilevered handle grip further having a hinge assembly which rotatably attaches the grip to the telescoping handle arm assembly, the hinge assembly having an upward stop flange and a downward stop flange which limit the rotation of the cantilevered handle grip around a hinge to approximately 30°.

6. The wheeled luggage apparatus of claim 5, wherein the hinge assembly further having a resilient element which supplies a force to the cantilevered handle grip and to the telescoping handle arm assembly, urging the grip to rotate downwardly around the hinge.

7. The wheeled luggage apparatus of claim 6 in which the resilient element is a spring.

8. The wheeled luggage apparatus of claim 5 in which the upward stop flange is positioned on an outside portion of the hinge such that the upward stop flange limits the upward rotation of the cantilevered handle grip to a position which is approximately perpendicular to the telescoping handle arm assembly.

9. The wheeled luggage apparatus of claim 5 in which a top surface of the grip is flush with an upright end of the wheeled luggage case, when the telescoping handle arm assembly is in a fully retracted position.

10. The wheeled luggage apparatus of claim 5 further having a grip cradle disposed within an upright end of the case, the cantilevered handle grip being adapted to be releasably locked within the cradle when the telescoping handle arm assembly is in a fully retracted position, allowing the grip to be used to carry the wheeled luggage apparatus.

11. The wheeled luggage apparatus of claim 5 further having a release button disposed within the grip, allowing a user to depress the button to unlock the grip from a grip locking assembly.

12. The wheeled luggage apparatus of claim 11 in which the button is adjacent to a back end of the cantilevered handle grip.

13. The wheeled luggage apparatus of claim 11 in which the button is flush with a top surface of the cantilevered handle grip.

14. A wheeled luggage apparatus, comprising:

a) a wheeled luggage case;

b) a telescoping handle arm assembly attached to the wheeled luggage case;

c) a hinge assembly which rotatably attaches a cantilevered handle grip to a top end of the telescoping handle arm assembly such that the plane of rotation of the grip is approximately parallel to the rolling direction of the wheeled luggage case and the grip extends across an upright end of the wheeled luggage case when the grip is rotated upward, d) a resilient element disposed within the hinge assembly which supplies a force to the cantilevered handle grip and to the telescoping handle arm assembly, urging the grip to rotate downwardly around a hinge;

e) an upward stop flange which is disposed on an outside portion of the hinge such that the flange abuts against the top end of the telescoping handle arm assembly and limits the upward rotation of the cantilevered handle grip around the hinge to a position in which the grip is oriented approximately perpendicular to the handle arm assembly; and f) a downward stop flange which is disposed on an inside portion of the hinge such that the flange abuts against the top end of the telescoping handle arm assembly and limits the downward rotation of the cantilevered handle grip to a position which is approximately 30 degree below the grip's perpendicular orientation to the handle arm assembly.

15. The resilient element of claim 14 in which the element is a spring.

16. The cantilevered handle grip of claim 14 in which a top surface of the grip is flush with an upright end of the wheeled luggage case, when the telescoping handle arm assembly is in a fully retracted position.

17. The wheeled luggage case of claim 14 further having a grip cradle disposed within an upright end of the case, the cantilevered handle grip being adapted to be releasably locked within the cradle when the telescoping handle arm assembly is in a fully retracted position, allowing the grip to be used to carry the wheeled luggage apparatus.

18. The cantilevered handle grip of claim 14 further having a release button disposed within the grip, allowing a user to depress the button to unlock the grip from a grip locking assembly.

19. The release button of claim 18 in which the button is adjacent to a back end of the cantilevered handle grip.

20. The release button of claim 18 in which the button is flush with a top surface of the cantilevered handle grip.

* * * * *